US006024104A

United States Patent [19]

Dolberry

[11] Patent Number: 6,024,104

[45] Date of Patent: Feb. 15, 2000

[54] COMBINATION WRITING UTENSIL AND FLOSS DISPENSER

[76] Inventor: Jeffery Dolberry, 7639 Dexter Grove Dr., Cordova, Tenn. 38018

[21] Appl. No.: 09/335,167

[22] Filed: Jun. 17, 1999

[51] Int. Cl.[7] ..... B43K 29/00

[52] U.S. Cl. ..... 132/325; 401/195; 132/309

[58] Field of Search ..... 132/309, 321, 132/323, 324, 325, 326, 328; 401/195, 52

[56] References Cited

U.S. PATENT DOCUMENTS

| | | | |
|---|---|---|---|
| D. 310,308 | 9/1990 | Wolsey | 401/195 |
| 3,853,134 | 12/1974 | McCord | 132/309 |
| 4,887,621 | 12/1989 | Vallieres | 132/309 |
| 4,957,125 | 9/1990 | Yaneza | 132/309 |
| 5,009,535 | 4/1991 | Oliar | 401/195 |
| 5,865,552 | 2/1999 | Manno | 401/195 |

*Primary Examiner*—Todd E. Manahan

[57] ABSTRACT

A combination writing utensil and floss dispenser for writing and dispensing floss. The combination writing utensil and floss dispenser includes an outer housing with separable dispensing and writing portions, opposite dispensing and writing ends, a longitudinal axis extending between the ends, and a marking device disposed in the housing and that is partially extendible through an opening in the writing end. A spool is rotatably or fixedly disposed in the dispensing portion. The spool has floss wrapped around it, a length of which extends through an aperture in the dispensing end of the housing. The dispensing end has a cutting blade for cutting the floss.

12 Claims, 3 Drawing Sheets

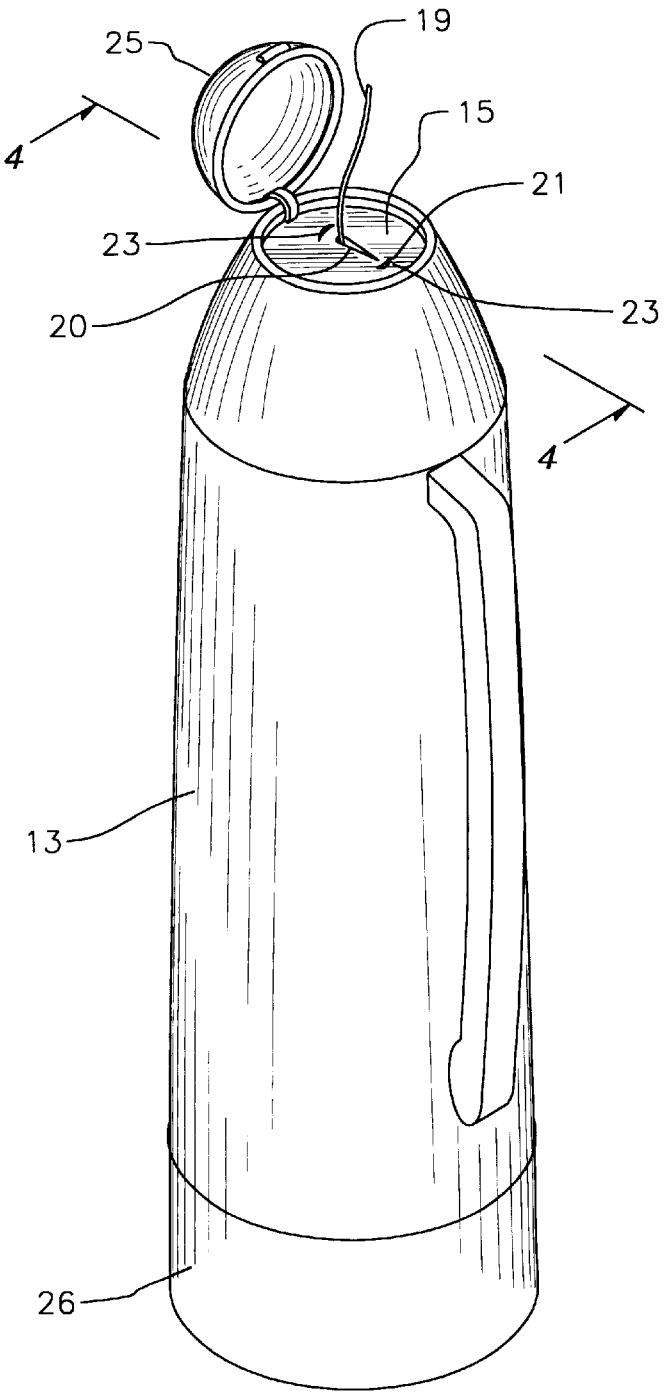
FIG. 3
FIG. 4
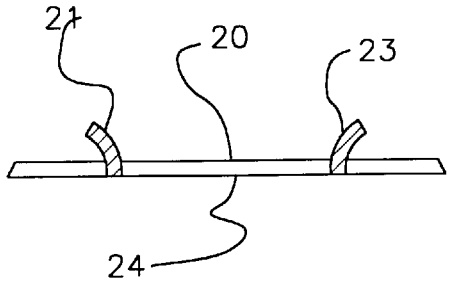

COMBINATION WRITING UTENSIL AND FLOSS DISPENSER

BACKGROUND OF THE INVENTION

1. Field of the Invention

The present invention relates to floss dispensers and more particularly pertains to a new combination writing utensil and floss dispenser for writing and dispensing floss.

2. Description of the Prior Art

The use of floss dispensers is known in the prior art. More specifically, floss dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,782,397; 3,963,358; 1,646,082; 2,512,168; 4,887,621; and U.S. Pat. No. Des. 115,916.

While these devices fulfill their respective, particular objectives and requirements, the aforementioned patents do not disclose a new combination writing utensil and floss dispenser. The inventive device includes an outer housing with separable dispensing and writing portions, opposite dispensing and writing ends, a longitudinal axis extending between the ends, and a marking device disposed in the housing and that is partially extendible through an opening in the writing end. A spool is rotatably or fixedly disposed in the dispensing portion. The spool has floss wrapped around it, a length of which extends through an aperture in the dispensing end of the housing. The dispensing end has a cutting means for cutting the floss.

In these respects, the combination writing utensil and floss dispenser according to the present invention substantially departs from the conventional concepts and designs of the prior art, and in so doing provides an apparatus primarily developed for the purpose of writing and dispensing floss.

SUMMARY OF THE INVENTION

In view of the foregoing disadvantages inherent in the known types of floss dispensers now present in the prior art, the present invention provides a new combination writing utensil and floss dispenser construction wherein the same can be utilized for writing and dispensing floss.

The general purpose of the present invention, which will be described subsequently in greater detail, is to provide a new combination writing utensil and floss dispenser apparatus and method which has many of the advantages of the floss dispensers mentioned heretofore and many novel features that result in a new combination writing utensil and floss dispenser which is not anticipated, rendered obvious, suggested, or even implied by any of the prior art floss dispensers, either alone or in any combination thereof.

To attain this, the present invention generally comprises an outer housing with separable dispensing and writing portions, opposite dispensing and writing ends, a longitudinal axis extending between the ends, and a marking device disposed in the housing and that is partially extendible through an opening in the writing end. A spool is rotatably or fixedly disposed in the dispensing portion. The spool has floss wrapped around it, a length of which extends through an aperture in the dispensing end of the housing. The dispensing end has a cutting means for cutting the floss.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combination writing utensil and floss dispenser apparatus and method which has many of the advantages of the floss dispensers mentioned heretofore and many novel features that result in a new combination writing utensil and floss dispenser which is not anticipated, rendered obvious, suggested, or even implied by any of the prior art floss dispensers, either alone or in any combination thereof.

It is another object of the present invention to provide a new combination writing utensil and floss dispenser which may be easily and efficiently manufactured and marketed.

It is a further object of the present invention to provide a new combination writing utensil and floss dispenser which is of a durable and reliable construction.

An even further object of the present invention is to provide a new combination writing utensil and floss dispenser which is susceptible of a low cost of manufacture with regard to both materials and labor, and which accordingly is then susceptible of low prices of sale to the consuming public, thereby making such combination writing utensil and floss dispenser economically available to the buying public.

Still yet another object of the present invention is to provide a new combination writing utensil and floss dispenser which provides in the apparatuses and methods of the prior art some of the advantages thereof, while simultaneously overcoming some of the disadvantages normally associated therewith.

Still another object of the present invention is to provide a new combination writing utensil and floss dispenser for writing and dispensing floss.

Yet another object of the present invention is to provide a new combination writing utensil and floss dispenser which includes an outer housing with separable dispensing and writing portions, opposite dispensing and writing ends, a longitudinal axis extending between the ends, and a marking device disposed in the housing and that is partially extendible through an opening in the writing end. A spool is rotatably or fixedly disposed in the dispensing portion. The spool has floss wrapped around it, a length of which extends through an aperture in the dispensing end of the housing. The dispensing end has a cutting means for cutting the floss.

Still yet another object of the present invention is to provide a new combination writing utensil and floss dispenser that is transportable in a shirt pocket or purse.

Even still another object of the present invention is to provide a new combination writing utensil and floss dispenser in which the floss spool and ink cartridge may be replaced.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic perspective view of the present invention.

FIG. 4 is a schematic cross sectional view of the present invention taken from line 4—4 of FIG. 3.

DESCRIPTION OF THE PREFERRED EMBODIMENT

Figure 1:
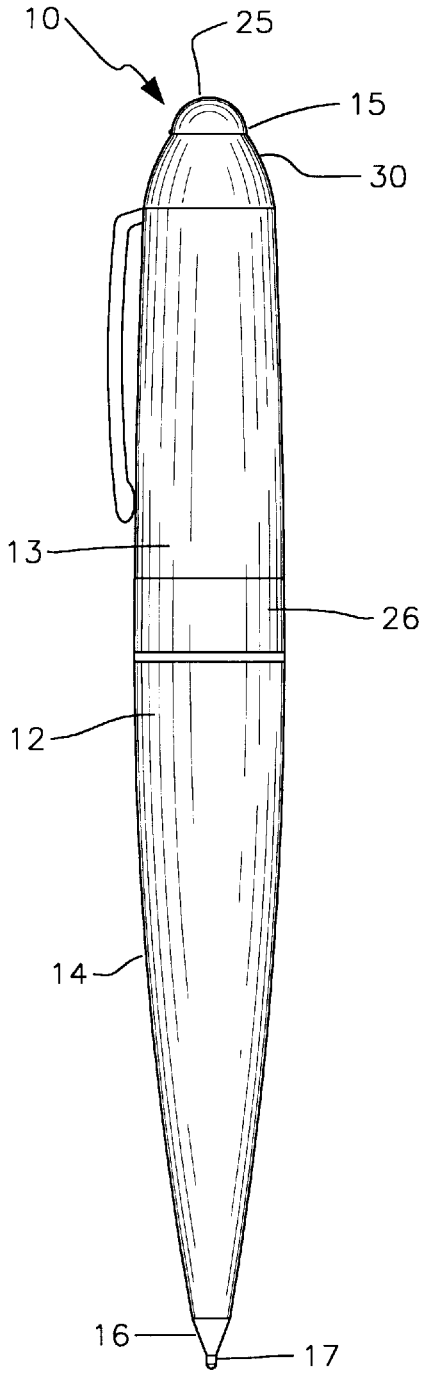
FIG. 1 is a schematic side view of a new combination writing utensil and floss dispenser according to the present invention.

With reference now to the drawings, and in particular to FIGS. 1 through 5 thereof, a new combination writing utensil and floss dispenser embodying the principles and concepts of the present invention and generally designated by the reference numeral 10 will be described.

As best illustrated in FIGS. 1 through 5, the combination writing utensil and floss dispenser 10 generally comprises an outer housing 12 with separable dispensing and writing portions 13,14, opposite dispensing and writing ends 15,16, a longitudinal axis extending between the ends, and a marking device 17 disposed in the housing and that is partially extendible through an opening in the writing end. A spool 18 is rotatably or fixedly disposed in the dispensing portion. The spool has dental floss 19 wrapped around it, a length of which extends through an aperture 20 in the dispensing end of the housing. The dispensing end has a cutting means 21 for cutting the floss.

The marking device may include an ink cartridge 22, pencil mechanism, marker, or the like. Any suitable means of the countless number known in the art may be employed to deploy and retract the marking device through the writing end.

Preferably, the cutting means comprises a pair of cutting flaps 23 extending at an angle from the dispensing end. See FIG. 4. Ideally, the cutting flaps are punched out of the metal of which the dispensing end is made. Most ideally, the cutting flaps curve downwardly back towards the dispensing end for easy manipulation as well as safety reasons.

Also preferably, the aperture in the dispensing end of the housing is elongate and has a generally tear drop shape such that side edges 24 of the aperture taper together to a point to frictionally engage the floss to hold it in place so that it doesn't slip back into the housing. The floss is pulled towards the point until it is pinched sufficiently between the side edges of the aperture. The cutting flaps could also perform a similar function by pulling the floss against the cutting flap until it is frictionally engaged but not yet cut.

Optionally, a cap portion 25 may be pivotally coupled to the dispensing end of the housing for covering the dispensing end to keep dirt off of the floss and out of the housing.

Preferably, the dispensing portion has a closing portion 26 that is detachable from a remainder of the dispensing portion for providing access to an interior of the dispensing portion for replacing the spool.

If the marking device is longer than the writing portion, the closing portion has a hole 27 therethrough. The marking device extends through the closing portion and through a portion of a lumen 28 of the spool. Ideally, the closing portion has a sealing ring 29 positioned towards the hole of the closing portion. The sealing ring slidably engages the marking device for preventing debris and ink from entering the interior of the dispensing portion.

Figure 2:
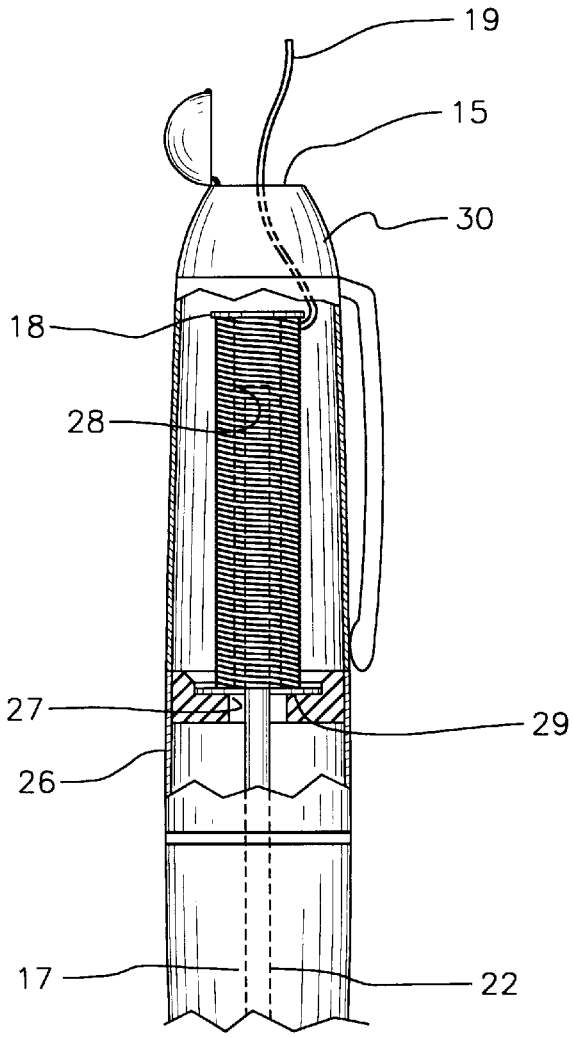
FIG. 2 is a schematic partial breakaway view of the present invention.
Figure 5:
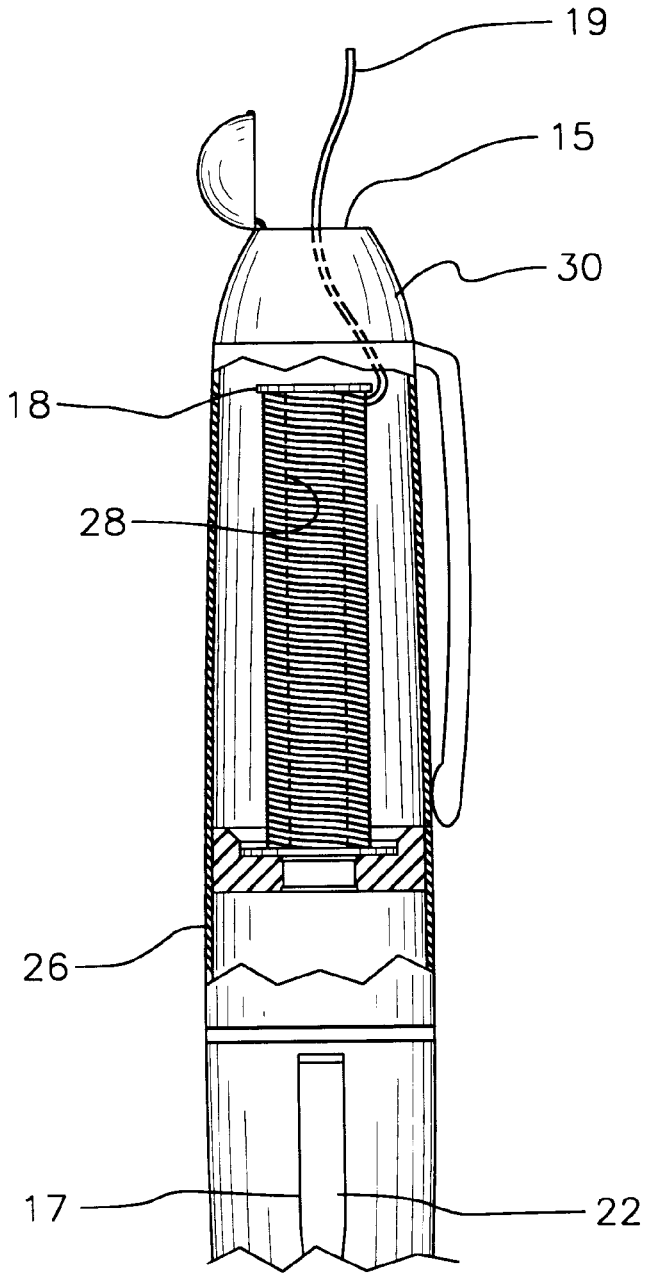
FIG. 5 is a schematic partial breakaway view of the present invention with a refillable ink cartridge.

Alternatively, a portion 30 of the dispensing portion towards the dispensing end could be removable just above the clip shown in FIG. 2 to provide access to the interior of the dispensing portion.

The preferred length of the housing between its ends is between about 4 and 8 inches, ideally about 6 inches.

In use, the cap portion is opened and the floss is pulled towards the round end of the aperture so that it is free to slide through the aperture. A desired length of floss is pulled out and cut free of the spool with the cutting means by pulling the floss against the cutting flap until it is either cut by the flap or cut by the scissors effect of pinching it between the flap and the dispensing end. The cap portion is closed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A writing utensil with floss dispenser, comprising:

an outer housing having separable dispensing and writing portions, opposite dispensing and writing ends, a longitudinal axis extending between said ends, and a marking device disposed in said housing and being partially extendible through an opening in said writing end, said marking device comprising an elongate cylindrical ink cartridge;

a spool being disposed in said dispensing portion, said spool having floss wrapped therearound, a length of said floss extending through an aperture in said dispensing end of said housing, said spool having a central passage extending therethrough such that a portion of the length of said elongate cylindrical ink cartridge extends into the central passage of the spool; and said dispensing end having a cutting means for cutting said floss.

2. The writing utensil of claim 1, wherein said cutting means comprises a pair of cutting flaps extending from said dispensing end.

3. The writing utensil of claim 1, wherein said aperture in said dispensing end of said housing is elongate and having a generally tear drop shape such that side edges of said aperture taper together to a point.

4. The writing utensil of claim 1, further comprising a cap portion pivotally coupled to said dispensing end of said housing for covering said dispensing end.

5. The writing utensil of claim 1, wherein said dispensing portion has a closing portion being detachable from a remainder of said dispensing portion for providing access to an interior of said dispensing portion for replacing said spool.

6. A writing utensil with floss dispenser, comprising:

an outer housing having separable dispensing and writing portions, opposite dispensing and writing ends, a longitudinal axis extending between said ends, and a marking device disposed in said housing and being partially extendible through an opening in said writing end;

a spool being disposed in said dispensing portion, said spool having floss wrapped therearound, a length of said floss extending through an aperture in said dispensing end of said housing; and said dispensing end having a cutting means for cutting said floss;

wherein said dispensing portion has a closing portion being detachable from a remainder of said dispensing portion for providing access to an interior of said dispensing portion for replacing said spool;

wherein said closing portion has a hole therethrough, said marking device extending through said closing portion and through a portion of a lumen of said spool.

7. The writing utensil of claim 6, wherein said closing portion has a sealing ring positioned towards said hole of said closing portion, said sealing ring slidable engaging said marking device for preventing debris from entering said interior of said dispensing portion.

8. The writing utensil of claim 6, wherein said cutting means comprises a pair of cutting flaps extending from said dispensing end.

9. The writing utensil of claim 6, wherein said aperture in said dispensing end of said housing is elongate and having a generally tear drop shape such that side edges of said aperture taper together to a point.

10. The writing utensil of claim 6, further comprising a cap portion pivotally coupled to said dispensing end of said housing for covering said dispensing end.

11. The writing utensil of claim 6, wherein said dispensing portion has a closing portion being detachable from a remainder of said dispensing portion for providing access to an interior of said dispensing portion for replacing said spool.

12. A writing utensil with floss dispenser, comprising:

an outer housing having separable dispensing and writing portions, opposite dispensing and writing ends, a longitudinal axis extending between said ends, and a marking device disposed in said housing and being partially extendible through an opening in said writing end;

a spool being disposed in said dispensing portion, said spool having floss wrapped therearound, a length of said floss extending through an aperture in said dispensing end of said housing;

said dispensing end having a cutting means for cutting said floss;

wherein said cutting means comprises a pair of cutting flaps extending at an angle from said dispensing end;

said aperture in said dispensing end of said housing being elongate and having a generally tear drop shape such that side edges of said aperture taper together to a point;

a cap portion pivotally coupled to said dispensing end of said housing for covering said dispensing end;

said dispensing portion having a closing portion being detachable from a remainder of said dispensing portion for providing access to an interior of said dispensing portion for replacing said spool;

said closing portion having a hole therethrough, said marking device extending through said closing portion and through a portion of a lumen of said spool; and wherein said closing portion has a sealing ring positioned towards said hole of said closing portion, said sealing ring slidably engaging said marking device for preventing debris from entering said interior of said dispensing portion.

* * * * *